US007308784B2

(12) United States Patent
Appelbaum et al.

(10) Patent No.: US 7,308,784 B2
(45) Date of Patent: Dec. 18, 2007

(54) APPARATUS AND METHOD FOR PACKAGING ARTICLES IN CLEAR PLASTIC PACKAGES

(76) Inventors: Paul Appelbaum, 16371 Wimbledon Ave., Huntington Beach, CA (US) 92649; Frank Matheus, 22251 Shadow Ridge, Mission Viejo, CA (US) 92692

( * ) Notice: Subject to any disclaimer, the term of this patent is extended or adjusted under 35 U.S.C. 154(b) by 109 days.

(21) Appl. No.: 11/400,831

(22) Filed: Apr. 10, 2006

(65) Prior Publication Data

US 2007/0084744 A1 Apr. 19, 2007

Related U.S. Application Data

(63) Continuation-in-part of application No. 11/251,650, filed on Oct. 17, 2005, now abandoned.

(51) Int. Cl.
*B65B 5/04* (2006.01)
*B65B 51/10* (2006.01)

(52) U.S. Cl. ..... 53/467; 53/477; 53/250; 53/329.4; 53/377.4; 53/377.6; 53/377.8; 53/378.3; 53/382.2

(58) Field of Classification Search ..... 53/467, 53/468, 329.4, 377.4, 377.6, 377.8, 378.3, 53/382.2, 250
See application file for complete search history.

(56) References Cited

U.S. PATENT DOCUMENTS 3,866,393 A * 2/1975 Warner et al. ..... 53/574
3,877,205 A * 4/1975 Gundersen ..... 53/139.2
3,884,015 A * 5/1975 Melton ..... 53/131.2
4,297,826 A * 11/1981 Woertche ..... 53/157
5,603,203 A * 2/1997 Robache ..... 53/559
6,550,224 B2 * 4/2003 Kleinschmidt ..... 53/453

FOREIGN PATENT DOCUMENTS

JP 06171609 A * 6/1994

* cited by examiner

*Primary Examiner*—John Sipos

(57) ABSTRACT

Apparatus for packaging articles in clear clamshell packages includes a pair of parallel relatively narrow, laterally spaced apart conveyor belts that support there-between a package in open position by its opposing side peripheries. A stack of packages is supported in nested configuration adjacent the front end of the conveyor and de-nester mechanism withdraws packages there-from and places them on the conveyor.

As the package is advanced a robotic arm picks and places articles of commerce and associated product information card in the package cavity. A rotating roller coated with UV-responsive adhesive coats raised male surfaces of the advancing package. Next an air knife sends a jet of air upwardly to cause the open package lid to rotate upwardly to cover the article-receiving portion. A driven roller presses the lid downwardly to fully close it and cause the adhesive coated surfaces to fully engage the corresponding grooves on the article-receiving portion. The package is then delivered to a UV illumination chamber where the UV adhesive in instantly cured to seal the package.

18 Claims, 5 Drawing Sheets

APPARATUS AND METHOD FOR PACKAGING ARTICLES IN CLEAR PLASTIC PACKAGES

This is a Continuation-in-part of application Ser. No. 11/251,650, filed 10/17/2005, now abandoned.

BACKGROUND OF THE INVENTION

1. Field of the Invention

The present invention relates generally to apparatus and methods for packaging clear plastic packages for small articles. More particularly it relates to UV packaging systems for clamshell type packages.

2. Description of the Prior Art

It has become popular to secure small articles of commerce in clear plastic packages such as clamshell-type packages and that permit prospective purchasers a view of the product while providing a seal against tampering and pilferage. Advances in the industry have led to the development of UV adhesive based systems whereby articles of commerce and associated product information card are placed in the cavity of a clamshell package, adhesive applied along "proud points" or raised male portions of the package, then the lid is manually closed to bring the proud points into corresponding grooves, and then the closed package is sent to a UV illumination chamber for instant curing and sealing.

Although improved packaging has resulted, conventional methods for producing these packages are labor intensive and remain limited by interruptions, excessive dwell-time and pauses.

SUMMARY OF THE INVENTION

In view of the foregoing it is a general object of the present invention to provide an improved method and apparatus for packaging items in clam-shell packages.

Another object is to provide a quicker, more effective as well as versatile way to package items.

These and other objects and advantages are provided by the present invention of a method for packaging articles in clear plastic clamshell packages of the type having a first portion with an article-receiving cavity, and a lid portion that is hinged to the article-receiving portion. The lid has raised parts or "proud points" or raised male portions extending along its periphery and the other portion has complementary grooves for receiving the proud points.

The invention includes a conveyor assembly comprising a pair of relatively narrow conveyor belts that are laterally spaced apart so as to support a package by its opposing peripheries. Lateral spacing is adjustable for supporting packages of differing widths.

In a preferred embodiment there is dispensing means for supporting a multitude of packages in stacked nested configuration in open position with the bottoms of packages fully received in the cavity portions of adjoining packages, and for successively withdrawing the lowermost package from the stack and placing it on the front end of the moving conveyor belts to provide packages spaced along the conveyor in open, lid-forward positions. In one preferred embodiment a pivotally mounted arm has releasable suction means on its free end and is adapted to rotate back and forth to grasp the lowermost supported package by releasable suction means and place it on the conveyor.

One preferred embodiment of the invention incorporates a robotic arm unit that senses speed and position of advancing packages on the conveyor, and will grasp pre-positioned articles of commerce and any associated product cards and place and release the same into the cavity of advancing packages.

Spaced above and transverse of the conveyor surface is a rotating UV adhesive-coated roller that coats the proud points of advancing packages.

The package is further conveyed to the point where sensor means triggers an upward jet of air from an air knife for a predetermined duration, which jet impacts the package lid causing it to rotate to a closed position, the proud points making initial engagement with the grooves. Next, rotating roller means spaced above the conveyor assembly urges the lid into full closure, which fully engages the proud points and grooves, effectively spreading adhesive over the engaged surfaces. Finally the package is delivered to a UV illumination chamber where the adhesive is instantly cured to complete the package.

In a preferred embodiment, a unique arrangement of pressure rollers and UV LED arrays is employed to provide improved UV sealing.

In a variant of the invention the conveyor assembly has three relatively narrow, parallel, spaced apart conveyor belt units, the middle of said belt units cooperating with the other belt units to provide two parallel means for advancing said packages.

Preferably the middle belt is adapted for being disassembled so that the other belt units combine to provide a single track for handling substantially wider packages.

DETAILED DESCRIPTION OF THE INVENTION

Figure 1:
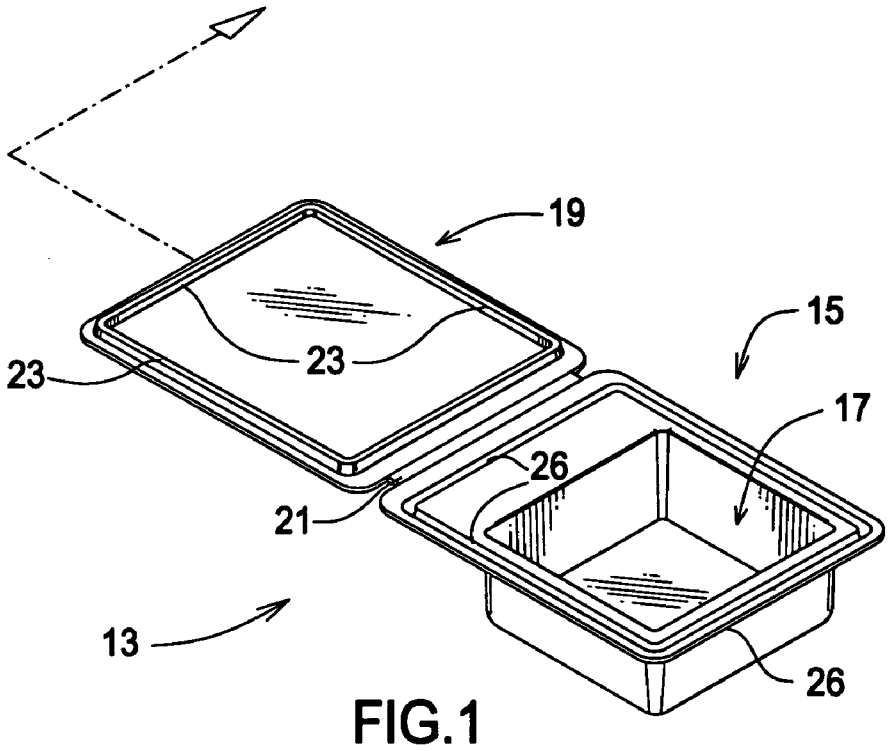
FIG. 1 is a perspective view of a typical clamshell package of the type used in apparatus and method according to a preferred embodiment of the present invention.

Referring now to the drawings, FIG. 1 shows a clamshell package 13 which is typical of clear plastic packages produced using techniques known in the plastics molding industry and which can be advantageously handled according to the present invention. It includes a first portion 15 that has an article-receiving cavity 17, and a lid 19 attached by hinge 21 to the portion 15. Note that the periphery of lid 19 is characterized by a raised male portion or proud points 23, and the periphery of the article-receiving portion 15 is provided with complementary grooves 26.

Figure 2:
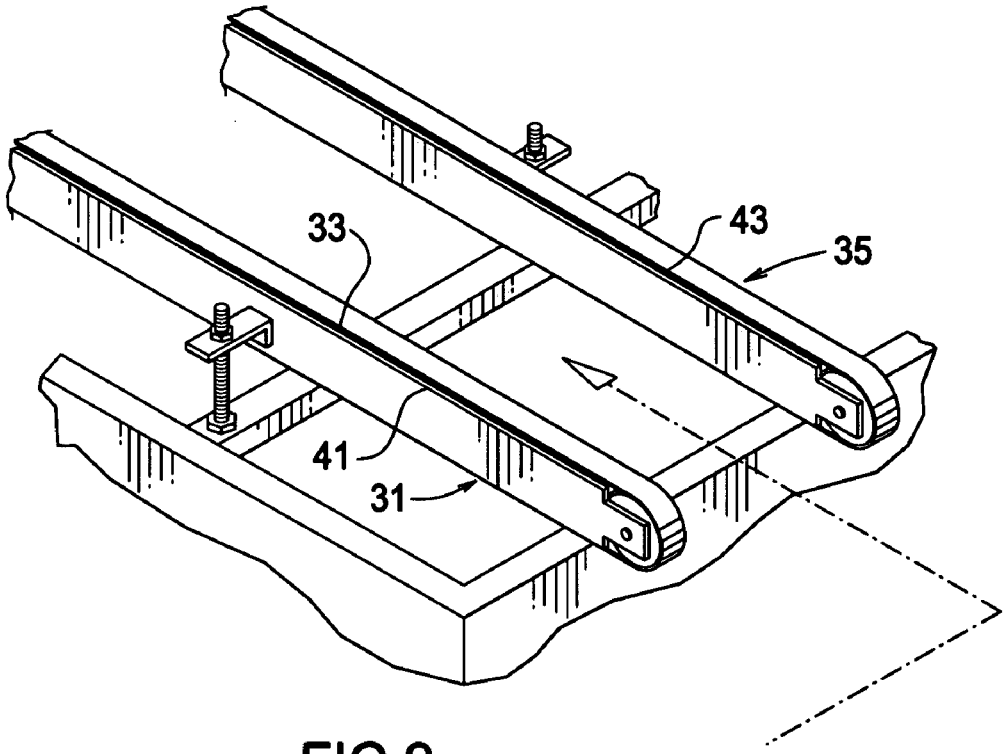
FIG. 2 is a partial perspective view of the conveyor assembly used in the present invention.

FIG. 2 shows that a conveyor assembly according to the invention includes parallel motorized conveyor belt units 31 and 35 which are supported by conventional means (not shown) in a manner allowing adjustment of the lateral spacing between the units. Note that the conveyor unit 31 includes a conveyor belt 33 supported vertically by a flat underlying frame member 41. The other unit 35 has a belt 43 that is similarly supported.

The spacing between units 31 and 35 is adjusted to support package 13 in its open position shown, by the peripheries of its opposing sides. Adjustment between the units can be made as desired to accommodate packages of differing widths. Also, there is sufficient vertical clearance below the level of the belts to allow package conveyance to be unhindered by the downward projection of the cavity portion 17.

Figure 3:
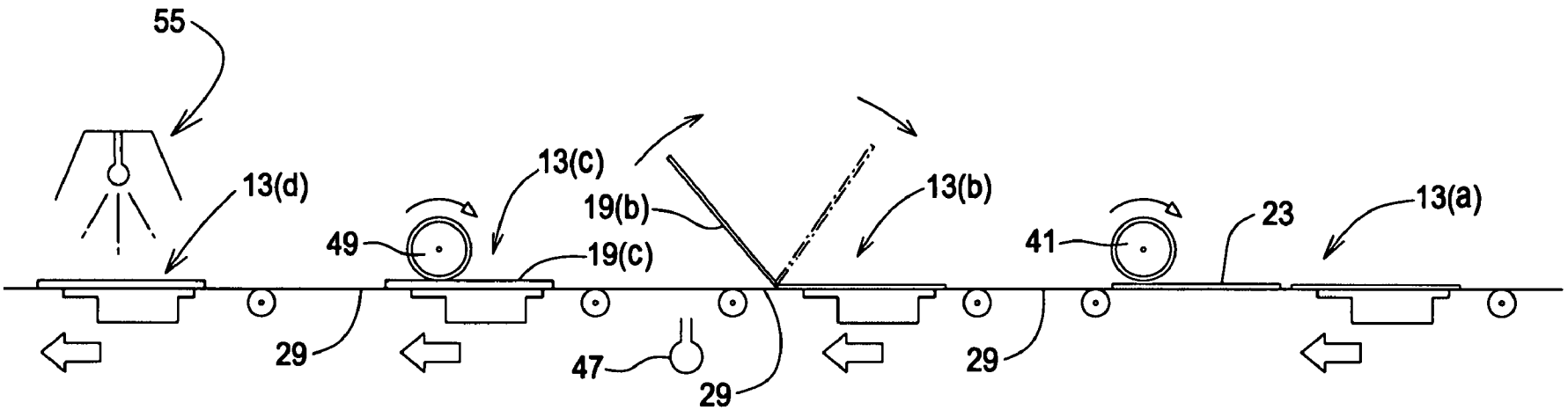
FIG. 3 is a side elevational schematic view illustrating apparatus according to the present invention.

The general method and apparatus of the present invention can be appreciated by reference to FIG. 3 which schematically illustrates how a package 13(*a*), placed on conveyor assembly 29 can be advanced towards a rotating adhesive-coated roller 41 which is aligned to engage and coat the proud points 23. Such applicators are commercially available under the mark "Simpl-Coater". Before or just after the package leaves the adhesive coater it is preferred that the relevant articles of commerce and associated product card are placed within the package cavity 17. In this regard it will be appreciated that the invention lends itself to the use of robotics to perform the task of loading the package cavity. Thus it is contemplated that a robotic arm, with control means sensing conveyor speed and package position, can grasp product from a set position and place it in the cavities of advancing packages.

FIG. 3 further illustrates a conventional air knife 47, for producing an upward steam of air. A conventional photosensor detects an advancing package 13(*b*) and triggers a jet of predetermined duration which causes the lid 19(*b*) to flip up, as illustrated, to a covering position. In this regard it is preferable that the package hinge 21 is a so-called "living" hinge having flexibility such that the lid will not tend to spring back towards its open position once it is rotated beyond an upright position.

FIG. 3 further shows how a closed package 13(*c*) is brought to a closing roller 49 that rotates in synchronization with the conveyor speed and which is set up to engage and urge the lid 19(*c*) downwardly causing the package proud points to make full engagement within the complementary grooves, which also ensures proper spreading of the liquid adhesive over the engaged surfaces.

Finally the package, shown as 13(*d*), is fed for conveyance through a UV illumination chamber 55 where the adhesive is instantly cured to complete the packaging.

Figure 4:
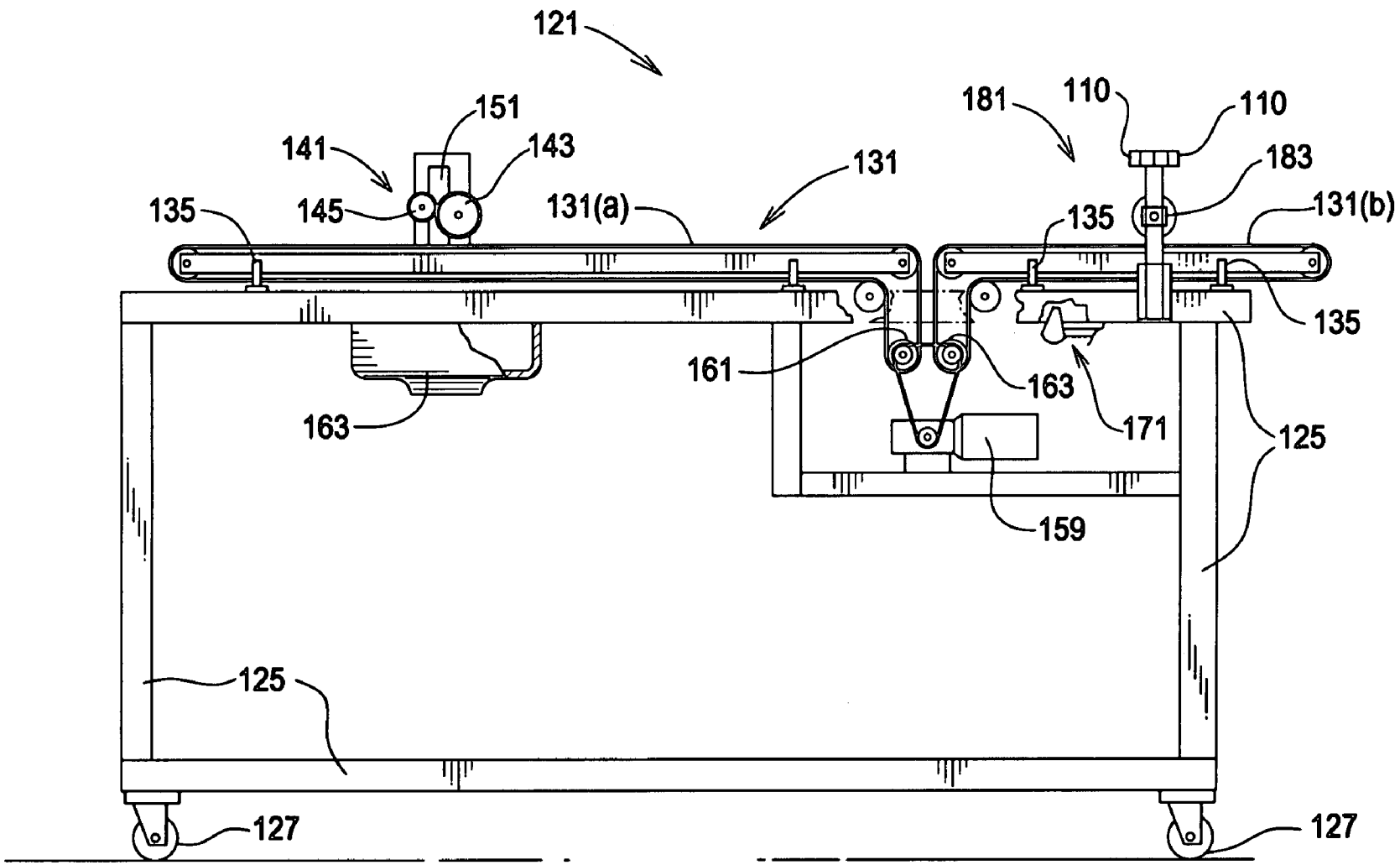
FIG. 4 is a side elevational view, partially sectional, and with parts broken away for the sake of clarity, of a module according to the invention.

A preferred embodiment of apparatus according to the invention is shown in FIG. 4 in the form of a module 121 that includes a support frame 125 that is maneuverable via wheel units 127. Module 121 includes a pair of conveyor belt units, spaced laterally apart like the units 31 and 35 shown in FIG. 2. It suffices to show only one such conveyor unit in FIG. 4, namely unit 131, since its construction mirrors that of the other.

FIG. 4 shows that the conveyor belt unit 131 comprises belts 131(*a*) and 131(*b*) that are in tandem and connected to the support frame by bolts 135. Note the variable-speed electric drive 159 that turns conveyor drive drums 161 and 163 so as to drive belts 131(*a*) and 131(*b*) respectively.

As FIG. 4 also shows there is a motorized adhesive applicator 141 that has counter-rotating rollers 143 and 145 that have their outer surfaces closely aligned such that liquid UV adhesive fed in the trough 151 will coat roller 143 which is spaced a preset adjustable distance above the conveyor belt 131(*a*). A trap 163 is positioned to capture excess adhesive.

FIG. 4 also shows an air knife 171 with an upwardly directed elongated slit—equipped nozzle, and mounted between the parallel conveyor units and connected to a source of pressurized air via a solenoid—powered air valve for controlling the air knife. Air knife 171 is controlled like the afore-described air knife 47.

Near the rear end of module 121 is a roller press unit 181 including motorized roller 183 that is vertically adjustable by virtue of a conventional knob-equipped screw mechanism 110. Its rotational speed is synchronized to the speed of the underlying conveyor belt. Module 121 can be maneuvered to bring the off end of conveyor 131 to the intake of a UV illumination device.

Figure 5:
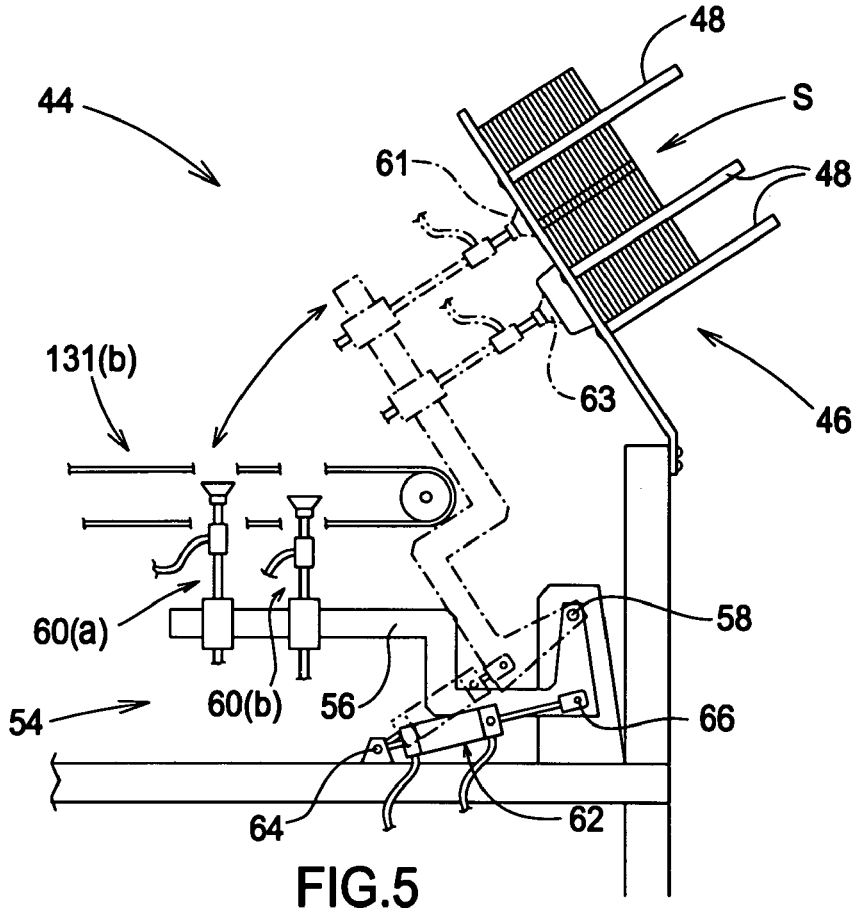
FIG. 5 is a side elevational view, with parts broken away for the sake of clarity, of a package de-nester employed in a preferred embodiment according to the present invention.
Figure 6:
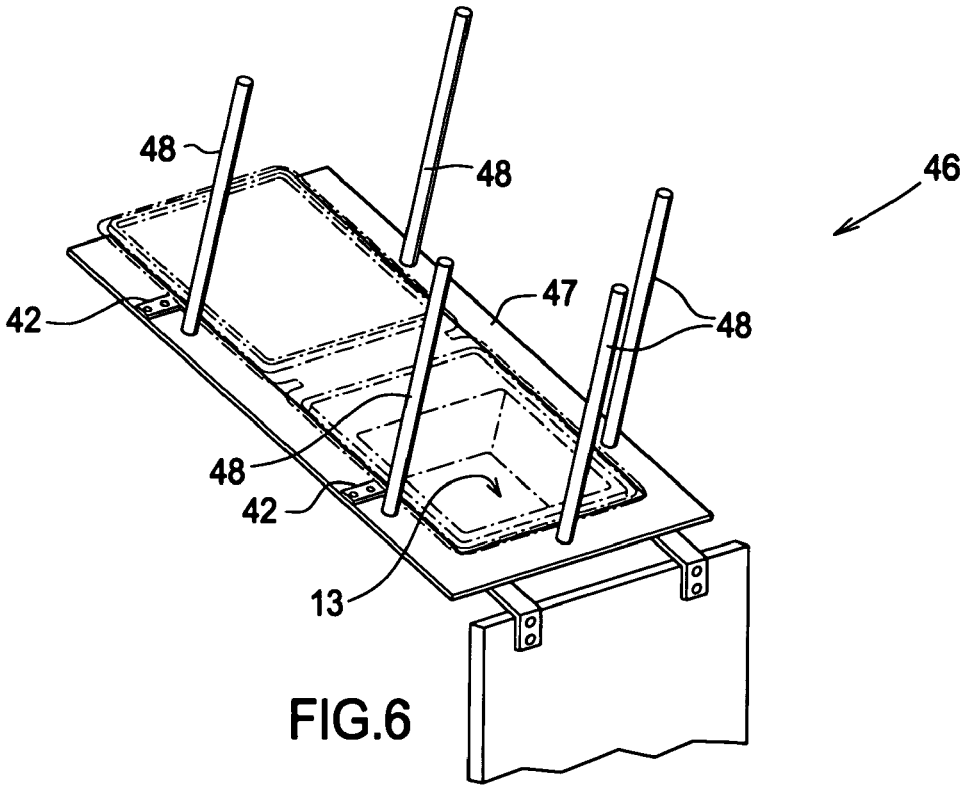
FIG. 6 is a partial, perspective view of the package holder of the de-nester of FIG. 5.

A preferred embodiment incorporates at the loading end of the module 121 a package de-nester apparatus 44, shown in FIG. 5. This includes a holder 46 for a nested stack S of packages. As FIG. 6 shows the holder 46 features a plate 47 that has an opening that is sized so that a package 13 is supported along its outer opposing peripheral portions which can flex resiliently. Posts 48 support and align the stack S, and adjustable tabs 42 allow for fine adjustment of the lateral spacing of the opening.

As FIG. 5 shows, the de-nester apparatus 44 has a grab-and place mechanism 54 for successively dispensing packages from the bottom of stack S and placing the same on conveyor belt unit 131, and it includes a working arm 56 with one end pivotally mounted at 58 and its distal portion mounting twin suction units 60(*a*) and 60(*b*). A pneumatic actuator 63 has its first end pivotally anchored at 64 and its other end pivotally connected to the working arm 56 at 66.

Note that the working arm 56 is positioned to make reciprocal rotational movement (indicted by arrows) in the space between the two conveyor belts of conveyor belt unit 131. Suction cup units 60(*a*) and 60(*b*) include venturi-type vacuum generators and are connected via coiled air lines and control valves (not shown) to a pressurized air source and are oriented so that when the arm 56 is rotated to the position shown in broken lines in FIG. 5, the cups 61 and 63 will releasably engage by vacuum force the flat undersurfaces of the lid and cavity-containing portions respectively. Alternatively the cup units can be connected to an electric vacuum generator.

Figure 7:
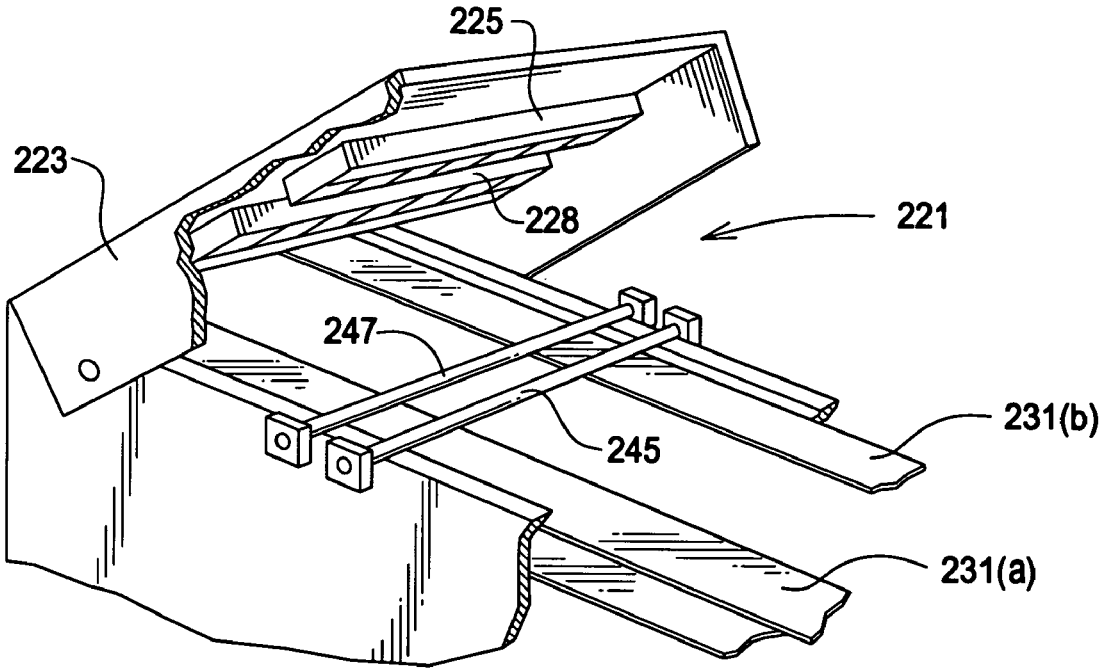
FIG. 7 is a perspective view with parts broken away, showing a UV LED powered illumination and roller arrangement according to a variant of the invention.
Figure 8:
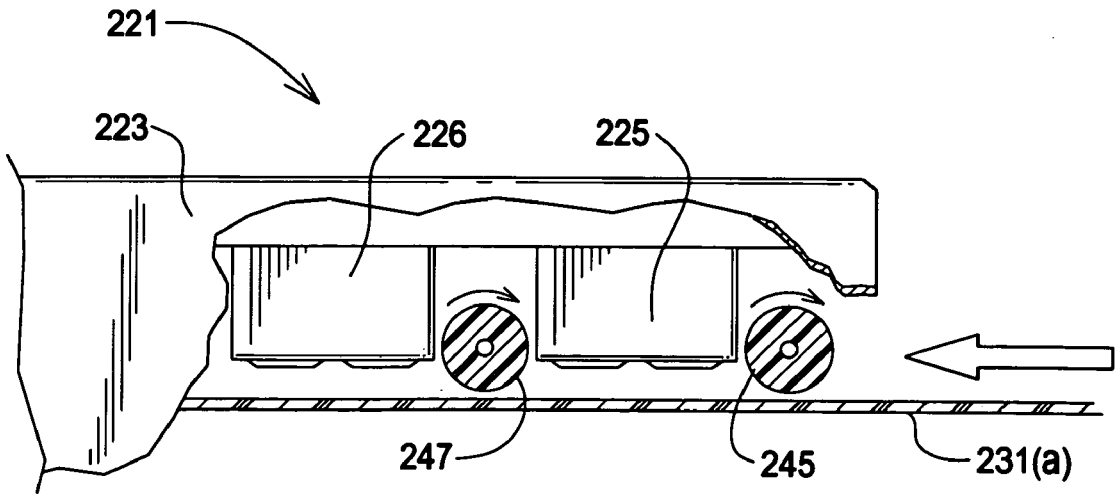
FIG. 8 is an enlarged, partial sectional view of the illumination and roller mechanism of FIG. 7.

In a preferred embodiment the take-off end of module 121 is provided with innovative UV LED-powered illuminator and roller mechanism 221, illustrated in FIGS. 7 and 8. FIG. 7 illustrates hinged hood 223 in open position, revealing linear LED arrays 225 and 226 that are arranged to span the belts 231(*a*) and 231(*b*) when the hood is closed. Note the driven rollers 245 and 247. Also note in FIG. 8 that when the hood is closed, the LEDs are brought in close proximity to the surface of the conveyor belt 231(*a*) to ensure optimal direct delivery of UV energy to the pertinent peripheral portions of a package. The LED arrays include LED units tuned at different wavelengths to ensure effectiveness despite variations in properties of package material and adhesive.

While particular embodiments of the invention have been shown, it is not intended that the invention be limited thereto. Various modifications and variations of the invention will be evident to persons of ordinary skill in the art, given the benefit of this disclosure, and it is intended that the invention be given its full scope and breath as defined in the claims that follow.

What is claimed is:

1. A method for packaging articles in clear plastic clamshell packages of the type having an article-receiving portion, and a lid portion that is hinged to the article-receiving portion, both portions having side flanges and one of said portions having raised parts extending along its periphery and the other portion having complementary grooves on its periphery for receiving the raised parts, said method including the steps of:

a) providing a multitude of said packages in nested configuration, the outer periphery of each package being flexible and resilient, and releaseably supporting the lowermost of said multitude by its outer periphery, while exposing flat major surfaces of said lowermost package;

b) grasping said surfaces of the lowermost package by vacuum means and dispensing said package from said nested multitude;

c) releasing the vacuum hold on said package and engaging said package by its opposing flanges and advancing it linearly with said package in an open position with its lid rotated about 180 degrees position ahead of the article-receiving portion relative the direction of movement;

d) inserting articles of commerce in the article-receiving portion of said package;

e) coating the raised parts of said advancing package with liquid UV adhesive;

f) directing a jet of air upwardly to cause the lid of said advancing package to rotate substantially towards a position covering said article-receiving portion;

g) pressing said rotated package lid downwardly by a roller causing said raised parts to fully engage said grooves; and h) illuminating said package with UV light to cause instant curing of said adhesive.

2. Method as defined in claim 1 wherein said UV illuminating is by LEDs.

3. Method as defined in claim 1 including providing said package with a living hinge such that the package lid will not spring back when rotated past an upright position.

4. Apparatus for packaging articles in clear plastic clamshell packages of the type having an article-receiving portion, and a lid portion that is hinged to the article-receiving portion, both portions having side flanges and one of said portions having raised tongue-like parts extending along its periphery and the other portion having complementary grooves on its periphery for receiving the raised parts, said apparatus including a) means for supporting said package by its opposing side flanges and linearly conveying and advancing said package, said conveying means having a front end and a rear end, and an upper surface;

b) means for supporting a multitude of said packages in nested configuration adjacent the front end of said conveying means, said supporting means adapted for the engaging and releasably holding the lowermost package of said multitude by the opposing side flanges of said package;

c) means for dispensing packages from said supporting means and placing them on the front end of said conveying means, said dispensing means including a suction cup unit for making releasable suction engagement with a major surface of said package, and adapted to and place and release said engaged package on the front end of said conveying means with the lid positioned ahead of the article-receiving portion relative the direction of movement of the conveying means;

d) UV adhesive application means extending across and above said conveying means and adapted to engage the raised parts of said package when said package is conveyed thereby;

e) air knife means, including upwardly directed nozzle mounted below the upper surface of said conveying means, for producing an upward pulse of air in response to detection of an advancing package whereby the open lid of said package is caused to be rotated towards a closed position;

f) ) roller press means mounted towards the rear, and across and above said conveying means and adapted to press downwardly of the lid of said package to effect full closure of said lid; and g) a UV light illumination chamber mounted towards the rear end of said conveying means for illuminating said package to cure the adhesive applied to said package.

5. Apparatus as defined in claim 4 wherein said conveying means includes a conveyor assembly having a pair of relatively narrow, spaced apart, conveyor belt units and means for adjusting the lateral spacing between said belt units.

6. Apparatus as defined in claim 4 wherein said means for supporting a multitude of said packages includes a support plate with guide means extending at about 90 degrees from the plane of said plate, and the guide means having spaced apart surfaces adapted to slidably support edges of said multitude of packages, said plate having an opening bordered by spaced apart parallel edges for engaging opposing flanges of said package.

7. Apparatus as defined in claim 4 wherein said dispensing means includes a working arm mounted at one end for rotation about a horizontal axis, and mounting said suction cup units at its distal end.

8. Apparatus as defined in claim 7 wherein said suction cup units include a venturi-type vacuum generator and are connected to a source of pressurized air.

9. Apparatus as defined in claim 7 including a central electrically powered vacuum generator in vacuum communication with said cup units.

10. Apparatus as defined in claim 6 including means for adjusting the spacing between said parallel edges.

11. Apparatus as defined in claim 4 including a robotic arm connected to means for sensing the position and speed of said package on said conveying means, whereby articles of commerce can be grasped from a supply location and placed in the article-receiving portion of said package.

12. Apparatus as defined in claim 4 wherein said UV illumination chamber includes an array of downwardly directed LEDs mounted above said conveying means upper surface, for emitting light in the range of UV wavelengths.

13. Apparatus as defined in claim 12 wherein said roller press means is mounted within said chamber.

14. Apparatus as defined in claim 13 wherein said array extends across said conveying means upper surface.

15. Apparatus as defined in claim 14 wherein said roller press means is within said illumination chamber and includes a roller mounted forward of and adjacent to said array.

16. Apparatus as defined in claim 4 wherein said conveying means comprises a conveyor assembly having three relatively narrow, parallel, spaced apart conveyor belt units, the middle of said belt units cooperating with the other belt units to provide two parallel means for advancing said packages.

17. Apparatus as defined in claim 16 wherein said middle belt is adapted for being disassembled so that said other belt units provide a single means for advancing said packages, and of greater span that each of the two other package conveying means.

18. Apparatus as defined in claim 12 wherein said array comprises plural transversely extending linear arrays of said LEDs, each line of said arrays having a different wavelength.

* * * * *